US005215287A

United States Patent [19]

Leski

[11] Patent Number: 5,215,287

[45] Date of Patent: Jun. 1, 1993

[54] VEHICLE LIFTER

[76] Inventor: Lenet Leski, 867 St. Clair St., Costa Mesa, Calif. 92626

[21] Appl. No.: 687,613

[22] Filed: Apr. 19, 1991

Related U.S. Application Data

[63] Continuation-in-part of Ser. No. 559,710, Jul. 30, 1990, abandoned.

[51] Int. Cl.[5] ..... E02C 3/00

[52] U.S. Cl. ..... 254/88; 254/122; 254/DIG. 4; 254/DIG. 1

[58] Field of Search ..... 254/88, 90, 94, 122, 254/124, 126, 3 R, 3 B, 3 C, 5 R, 5 B, 5 C, DIG. 4, DIG. 1

[56] References Cited

U.S. PATENT DOCUMENTS

| | | | |
|---|---|---|---|
| 912,589 | 2/1909 | Masher | 254/3 R |
| 1,401,463 | 12/1921 | Cordes | 254/88 |
| 1,408,408 | 2/1922 | Scott | 254/88 |
| 2,071,470 | 2/1937 | Marlowe | 254/126 |
| 4,078,269 | 3/1978 | Weipert | 254/122 |
| 4,486,006 | 12/1984 | Fawdry | 254/88 |
| 4,828,222 | 5/1989 | Rossato | 254/88 |

FOREIGN PATENT DOCUMENTS

| | | | |
|---|---|---|---|
| 566545 | 12/1932 | Fed. Rep. of Germany | 254/88 |

*Primary Examiner*—Robert C. Watson

[57] ABSTRACT

Vehicle lifter is a vehicle lifting jack, which is a modification of prior art scissor jack by replacing its top member with a wheel support plate, which has restricted pivotable movement, to enable it to be lowered to the ground at the wheel support plate low position, so that he vehicle wheel could enter on the top of the wheel support plate and obtain a stable position, then after placing the safety wedges, the vehicle lifter is operated by a conventional long handle ratchet wrench to obtain wheel support plate high position, securing a high, unobstructed working space under the vehicle and yokes are used to secure a small forward inclined position of the wheel support plate, while the vehicle lifter is being raised or lowered.

10 Claims, 3 Drawing Sheets 7
7
28
28
1
29
29
9
4
11
8
3
12A,12B
17A,17B
6A,6B
21
26
27
19A,19B
23
24
22
20A, 20B
31
10A,10B
35
33

FIG. 8
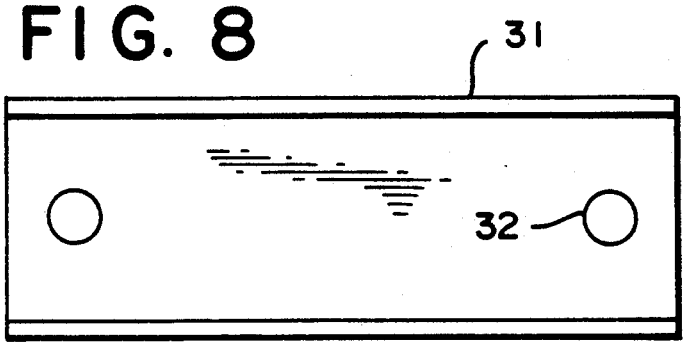
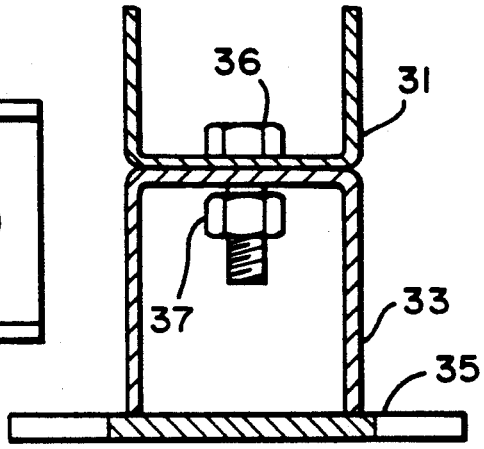
FIG. 11
FIG. 9
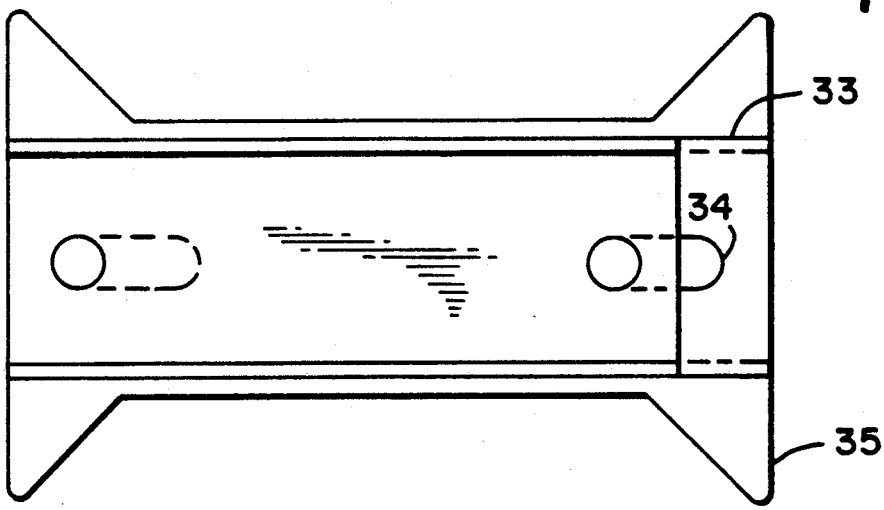
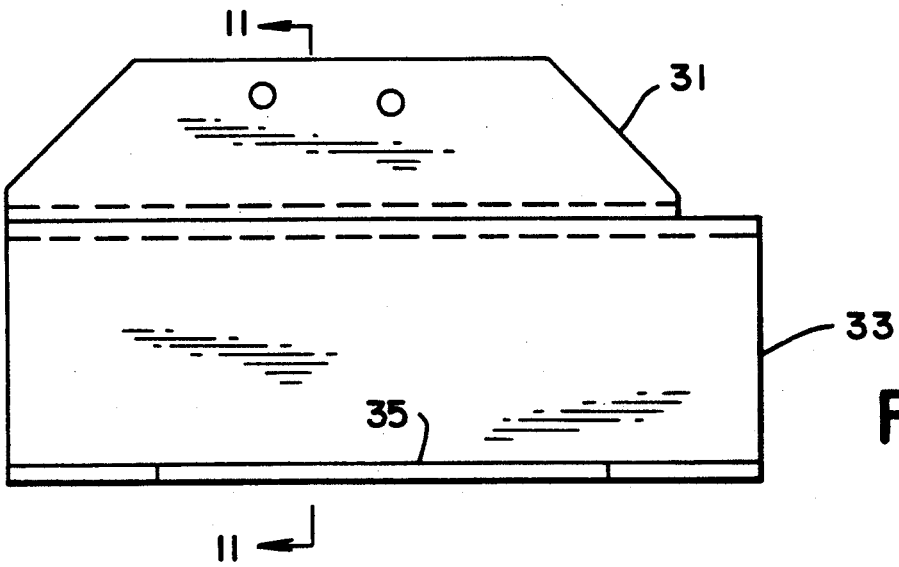
FIG. 10

VEHICLE LIFTER

This is a continuation-in-part-application of a prior application Ser. No. 07/559,710 filed Jul. 30, 1990, now abandoned.

BACKGROUND OF THE INVENTION

1. Field of the Invention

This invention relates in general to vehicle safety and in particular to vehicle lifting tools.

2. Description of the Prior Art

The work under a vehicle which is standing on the ground is very unpleasant, difficult and dangerous, because poor accessibility and not enough room for movement of hands and tools, that may cause scratches and wounds on hands.

There are several lifting devices which are supplied with vehicles by the manufacturers. One device is a bumper jack which engages a hole in a bumper. It can lift one corner of a vehicle by movement of a metal rod up and down. It can only be used safely for vehicles that have holes in their bumpers.

There are also small pneumatic jacks on the market available for the vehicle owners. A typical jack has four little wheels. By placing it under a vehicle body and rocking a lever, the jack can lift a corner or even a half of a vehicle.

The jack needs skill and knowledge which part of the vehicle is strong enough to support the heavy weight. All of the manually operated jacks have insufficient lifting height, they occupy room under the vehicle and restrict the movement of a person.

For lifting a vehicle only a portable ramp is used on which a vehicle wheel can be moved and lifted 8 inches above the ground. But this ramp can not be used for changing wheel, which is the most frequent occurence in emergency. It is heavy and bulky and can not be carried in the vehicle.

Another tool which is a pivotable linkage device with a scissor type movement of its links, called scissor jack is shown on U.S. Pat. No. 3,741,524 (Morgan). This jack has a threaded driving rod with an enlarged hexagonal head. The jack is placed under the side of a vehicle with its top member 22 engaging a specially provided notch on the body of the vehicle. By turning the rod with a specially supplied wrench, one corner of the vehicle can be lifted and the wheel changed.

The wrench can make only half turn and must be readjusted every half turn, what is a nuissance.

U.S. Pat. No. 4,055,329 (Hammond) shows a jack for stabilizing a parked vehicle. Four such jacks would be permenently mounted on four corners of a vehicle. Both of above cited scissor jacks obstruct the working space and neither engages the tire.

U. S. Pat. No. 3,252,369 (Gridley) shows a large structure on wheels with a platform for lifting construction material on a building site. Besides that it has links it has no other similarity to the vehicle lifter.

Pat. No. 546,545 (Wagner), Germany and U.S. Pat. No. 1,408,408 (Scott). Both these patents show a stationary, horizontal platform of a large size for a convenient work on motorcycles. The platform can be inclined to the ground and after the motorcycle would be moved on it, the platform would tilt back to horizontal level by gravity force, as it is pivotally supported. Wagner shows also a hydraulic brake for preventing bumps.

U.S. Pat. No. 1,401,463 (Cordes) and U.S. Pat. No. 4,486,006 (Fawdry). Both these references show a very large stationary platform pivotally mounted which can be inclined to the ground level and a four wheel vehicle could be driven on the platform. When the vehicle would pass the pivotal point the platform would tilt by the vehicle weight to horizontal level determined by multiple supports. To prevent damage of the structure by heavy bumps and control the tilt, telescopic dampers are provided. Platform of Cordes is shaped like frame with openings in the center to allow the work on the underside of the vehicle. It differs greatly from the small lifter as to the size, construction and operation.

Fawdry patent shows two separate tracks for a four wheel vehicle. The tracks have separate pivots, supports and dampers. But driving on the narrow and long tracks, which are not rigidly joint may be risky.

U.S. Pat. No. 2,071,470 (Marlowe) shows scissor jack, which has the top member called dishhead bearing plate supported on two pins and is not pivotable. It is adapted to engage the body of a vehicle, preferably the axle. It has two stage of operation. First its dishhead bearing plate is brought in contact with the load by manually turning a crank mounted on the driving rod, then by using horizontally operated ratchet wrench, the driving rod is turned through a gear system to lift the load.

SUMMARY OF THE INVENTION

Vehicle lifter is a modification of prior art linkage device called scissor jack by replacing its top member with a wheel support plate which has a restricted pivotal movement, which enables the vehicle wheel to enter on the top of the vehicle lifter and assume a stable position. This is a new feature which is completely different from prior art vehicle lifting jacks. It enables the vehicle owner safe and convenient maintenance and minor repair work under the vehicle.

The main difference between this invention and the prior art scissor jacks is that this invention is lifting a vehicle by lifting its wheel, while the prior art jacks are engaging the vehicle body. Therefore this invention has no effect on the construction and strength of the vehicle components.

As could be realized from the prior art discussion, there is a need for an ample working space under the vehicle and for providing a good vehicle lifting device. Despite many attempts, this problem has not been completely solved, therefore: The object of this invention is to provide a tool that is small, safe, lightweight, inexpensive and easy to use by unskilled vehicle owners. Another object is that this tool should be portable and to be carried in the vehicle for emergency situation. Still another object is that this tool should not take any portion and not obstruct the working space under the vehicle and allow to lift the vehicle substantially higher, than the prior art scissor jacks.

For the greatest safety and the most convenient working condition, two vehicle lifters should be used, one under each wheel. They will allow simultaneous lifting of both wheels without twisting the vehicle body. The advantage of using two vehicle lifters will be much greater than the cost of the second lifter.

To complete the safety of this system, two properly made wedges should be provided and dept in the vehicle as a ready available accessory. This invention can also be used for wheel change. It can engage any part of the vehivle. It has gradual height adjustment, therefore it can be used for matching heights in trailer connection to the vehicle. It can also be used for levelling of a camper in recreation areas.

BRIEF DESCRIPTION OF THE DRAWINGS

FIG. 8 is a plan view of a modified new base.

FIG. 9 is a top view of the new base assembly.

FIG. 10 is a side elevation of the new base assembly.

FIG. 11 is a sectional view 11—11 taken from FIG. 10.

DESCRIPTION OF THE PREFERRED EMBODIMENT

Figures 1, 2, 3:
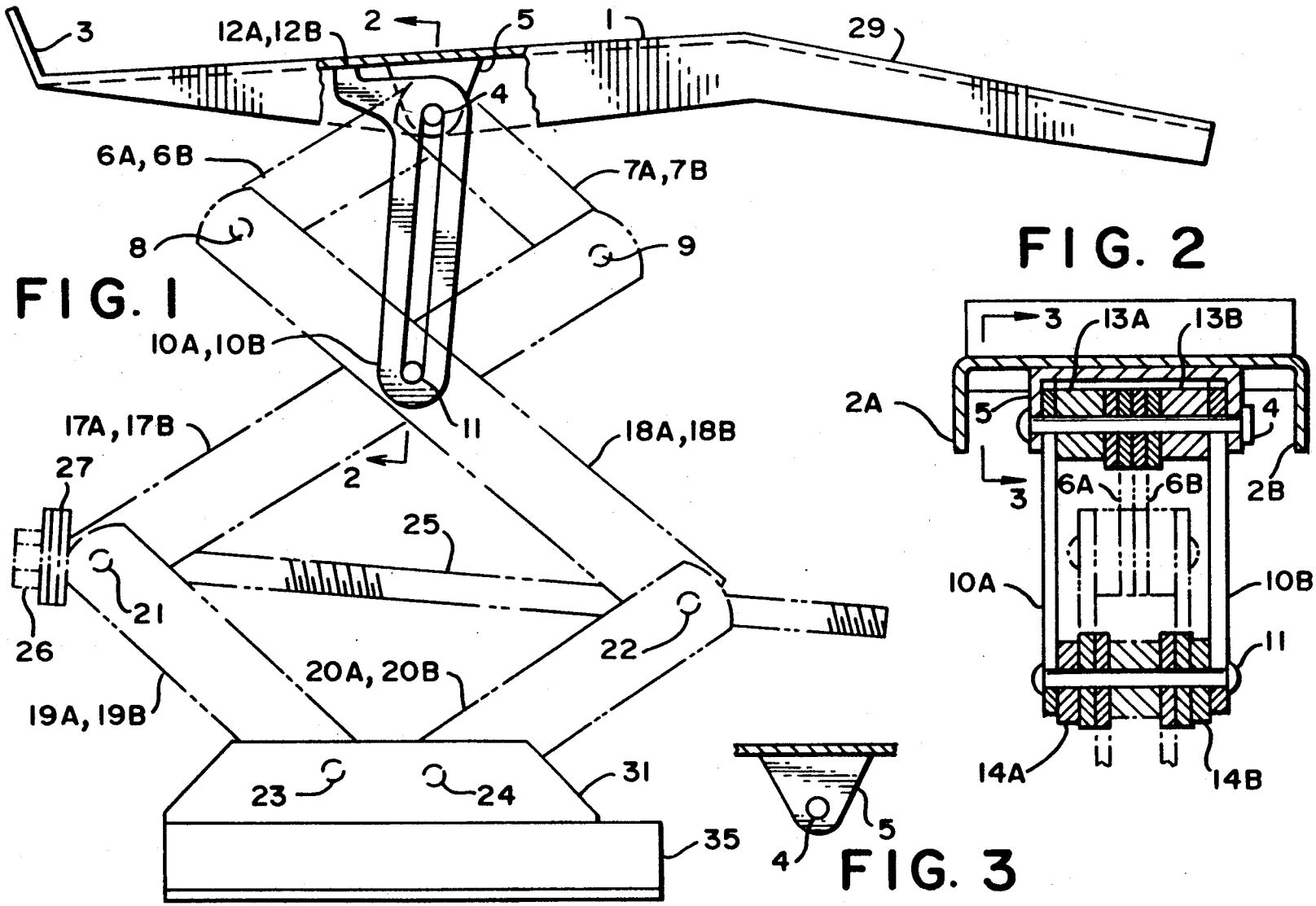
FIG. 1 is the side elevation of the vehicle lifter in raised position.
FIG. 2 is the section 2—2 taken from FIG. 1.
FIG. 3 is a partial section 3—3 taken from FIG. 2.

The phantom lines shown by a dash and a short line indicate element of the prior art, which is not a subject of this invention. Vehicle lifter has a steel base assembly consisting of base 31, base height extender and extender plate 35; two holes on the sides of the base are spaced for the prior art pins 23 and 24 on which the lower ends of the prior art links 19A, 19B and 20A, 20B are pivotally mounted.

All pivotal links are of prior art. They are flat steel bars and are duplicated, hence they are marked A and B. The upper ends of lower links 19A, 19B, 20A, 20B are pivotal on pins 21 and 22 respectively and are joined with the lower ends of the intermediate links 17A, 17B and 18A, 18B respectively. The upper ends of the intermediate links are pivotal on pins 8 and 9 joining with the lower ends of the links 6A, 6B and 7A, 7B respectively. The upper ends of both pairs of upper links are pivotally mounted on a new lifter top pin 4. The intermediate links are also pivotal on a new center pin 11 at the point where these links are crossing. A fully threaded driving rod 25 with its hexagonal head 26 and washer 27 are of prior art. By turning the rod, the linkage can be extended vertically, as shown on FIG. 1 or contracted, as shown on FIG. 4. A new wheel support plate 1 has adequate width for a size of a tire. It has two side flanges 2A, 2B bent downwards at the right angle to provide the rigidity for the plate. The front of the wheel support plate is bent upwards and becomes the wheel stop flange 3.

The wheel support plate is pivotally mounted on a plate supporting pin 4, which is the vehicle lifter top pin. The pin 4 is inserted in a new bracket 5. This bracket is attached to the bottom of the wheel support plate. The front portion of the wheel support plate is inclined at a small angle below the horizontal level to stabilize the vehicle wheel position on the lifter. In order to hold the angle and restrict further rotation of the plate, the yokes 10A, 10B are used. They are flat, lengthy, steel bars mounted on the lifter top pin 4 on both sides of the linkage, as shown on FIG. 2. Yokes have a narrow longitudinal slot in which pins 4 and 11 are slidably positioned. As the vehicle lifter is extended or contracted, the pin 11 is sliding in the slot and holding yokes in vertical position.

Yokes carry their function of holding the inclination of the wheel support plate by yokes extended arms 12A, 12B, which extends sideways from the upper ends of the yokes to the bottom of the wheel support plate.

By rotating the driving rod 25, the vehicle lifter is extended upwards in vertical configuration to its height position or it is contracted to its low position. In order to reduce the length of the vehicle lifter, the tail end of the wheel support plate is bent downwards, as it is shown by numeral 29.

To keep the yokes outside of the base, new spacers 13A, 13B and 14A, 14B are added, as it is shown on FIG. 2.

FIG. 8 shows the vehicle lifter base 31, which is a simple channel and has two equal round holes 32, and is positioned on the base extender 33, which is a similar channel of the same width and has two elongated holes 34 aligned with the holes of the base. Extender is an inverted channel, slidably connected bottom to bottom with the base by a bolt 36 and a nut 37.

Figures 4, 5, 6, 7:
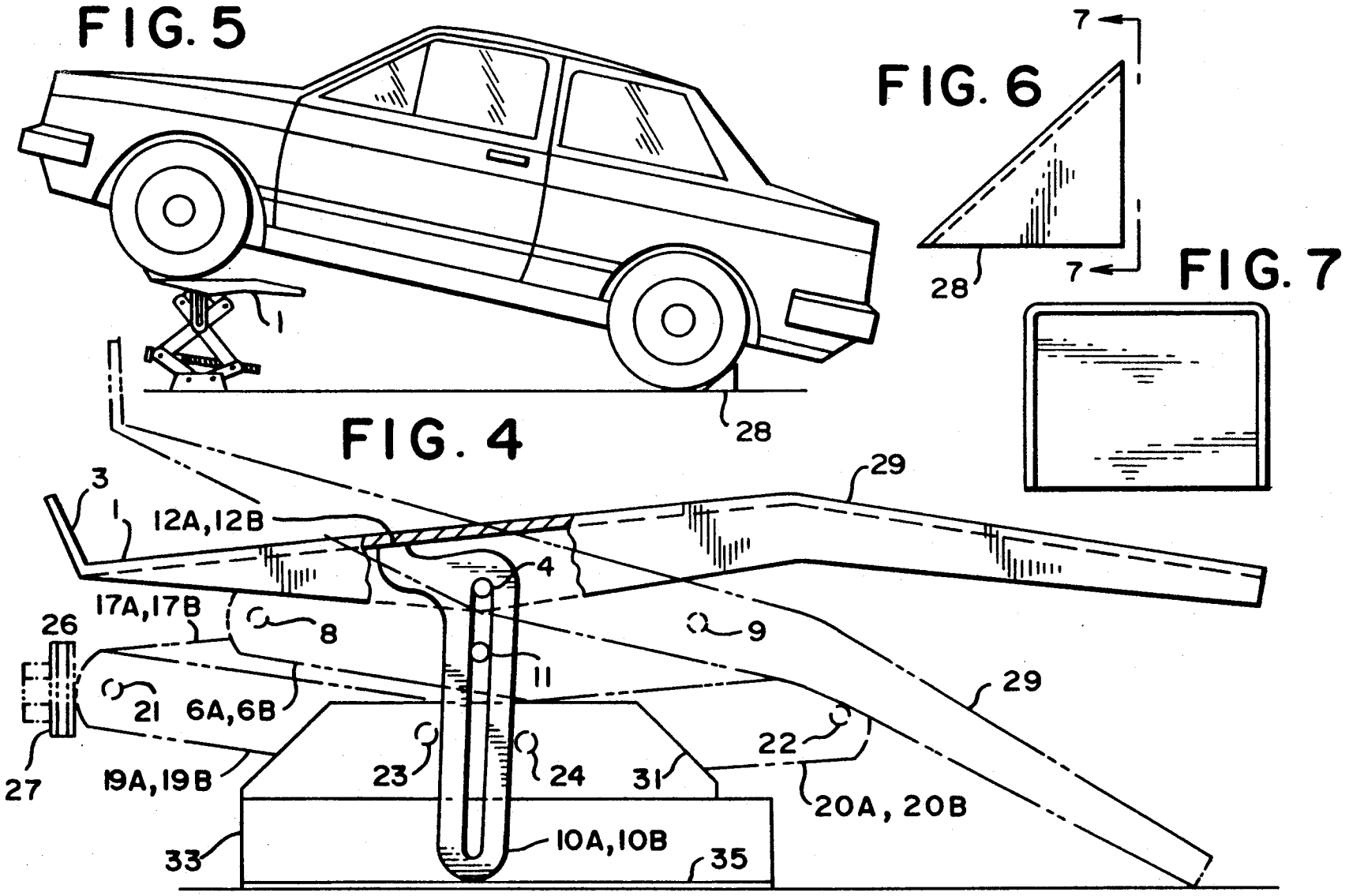
FIG. 4 is the side elevation of the vehicle lifter in low position.
FIG. 5 is a view on a car raised on the vehicle lifter.
FIG. 6 is a side elevation of a safety wedge.
FIG. 7 is a view 7—7 on FIG. 6.

As could be understood from FIG. 5, when the vehicle is lifted the vertical projection of the lifter top pin is moving backwards. To compensate for this, the base will slide on the extender to keep the vehicle lifter in vertical configuration. Sliding surfaces can be lubricated. The extender is welded to the extender plate 35.

Operation of vehicle lifter, as specified is very simple. The vehicle lifter is brought to its low position and placed in front of a wheel with tail portion 29 of the wheel support plate touching the ground, as it is shown in FIG. 4, then the vehicle is driven very slowly until its wheel will tilt the wheel support plate and the tire will touch the wheel stop flange. Then the vehicle brakes will be set and the wedges will be placed.

A fast and easy way to operate the vehicle lifter is by using a conventional long handle ratchet wrench with matching socket. By moving the handle up and down in vertical plane, the lifter will lift or lower the wheel. The additional expense for the wrench will be offset by the convenience of using it for removal of wheel lugs, when wheels will be changed.

A preferred operation of this invention, is by using two vehicle lifters, to lift two wheels at the same time, by operating both lifters alternately. The ratchet wrench would be especially useful in this case. In the same way the rear end of the vehicle can be lifted.

I claim:

1. A vehicle lifter including a scissor jack comprising wheel lifting and supporting means including a base assembly joined by pins and linkage means to form a scissor jack for raising or lowering the height of the vehicle lifter, said linkage means comprising links in a form of flat elongated steel bars, said links being pivotally connected by pins at the ends of said links, a fully threaded driving rod with a driving rod head being connected with said linkage means, said linkage means being pivotally connected with a wheel support plate, said wheel support plate having side flanges and a wheel stop flange, a bracket attached to said wheel support plate, wherein in said bracket a top pin of said linkage means is pivotally inserted, yokes with yoke extended arms at their tops having a longitudinal slot in which a center pin of said linkage means is slidably inserted.

2. Said wheel support plate of claim 1 being pivotally mounted on said lifter top pin by means of said bracket attached to the bottom of said wheel support plate.

3. Vehicle lifter according to claim 1, wherein said side flanges of said wheel support plate are bent downwards at a right angle and said wheel stop flange is bent upwards.

4. Vehicle lifter according to claim 1, wherein on said top pin the upper links of said linkage means are pivotally mounted.

5. Vehicle lifter according to claim 1, wherein said bracket contains said top pin on which said wheel support plate is pivotally mounted.

6. Vehicle lifter according to claim 1, wherein said yokes are mounted on said top pin on both sides of said linkage means, said yokes having arms extending to the bottom of said wheel support plate.

7. Vehicle lifter according to claim 1, wherein in said longitudinal slots of said yokes said top pin and said center pin are slidably positioned.

8. Vehicle lifter according to claim 1, wherein said driving rod means, includes a socket for engagement with a ratchet wrench to raise said wheel support plate to its high position or lower it to its low position.

9. Vehicle lifter of claim 1, wherein said base assembly having said base in a form of a channel with two round holes in the bottom and is slidably positioned bottom to bottom over a base extender, which is of channel shape sliding surfaces being lubricated.

10. Vehicle lifter of claim 1, wherein said base assembly includes a base in a form of a channel with two elongated holes in the bottom, aligned with the holes of a base, said base extender having an extender plate welded to its bottom.

* * * * *